US007170233B2

(12) United States Patent
Adachi et al.

(10) Patent No.: US 7,170,233 B2
(45) Date of Patent: Jan. 30, 2007

(54) SELF LIGHT EMITTING DISPLAY PANEL AND DRIVE CONTROL METHOD THEREFOR

(75) Inventors: Shinobu Adachi, Yonezawa (JP); Mayumi Ozaki, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 11/175,274

(22) Filed: Jul. 7, 2005

(65) Prior Publication Data

US 2006/0007075 A1 Jan. 12, 2006

(30) Foreign Application Priority Data

Jul. 8, 2004 (JP) ..... 2004-201459

(51) Int. Cl.
*G09G 3/10* (2006.01)
*G09G 3/30* (2006.01)

(52) U.S. Cl. ..... 315/169.3; 315/169.2; 345/76

(58) Field of Classification Search ..... 315/161, 315/169.1, 169.2, 169.3; 345/211–214, 690, 345/76–77, 84
See application file for complete search history.

(56) References Cited

U.S. PATENT DOCUMENTS 5,440,322 A * 8/1995 Prince et al. ..... 345/58
5,929,832 A * 7/1999 Furukawa et al. ..... 345/98
6,040,826 A * 3/2000 Furukawa ..... 345/534
6,806,862 B1 * 10/2004 Zhang et al. ..... 345/103
7,027,018 B2 * 4/2006 Nitta et al. ..... 345/87
7,038,651 B2 * 5/2006 Nitta et al. ..... 345/98

FOREIGN PATENT DOCUMENTS

JP 2002-169510 6/2002
JP 2003-302937 10/2003
JP 2004-70057 3/2004

* cited by examiner

*Primary Examiner*—Thuy Vinh Tran
(74) *Attorney, Agent, or Firm*—Westerman, Hattori, Daniels & Adrian, LLP.

(57) ABSTRACT

In the upper half and a lower half of a display area, scanning is implemented such that the directions of scan selection operations are different from each other. The upper half of the panel is scanned from the upper end to the center of the screen, and at the same time the lower half of the panel is scanned from the lower end to the center of the screen. Control is performed such that the difference between the start time of the scan selection operation of the upper half of display area and the start time of the scan selection operation of the lower half of the display area is scanning time of at least one or more scan lines. The configuration avoids a problem that a bright line is generated momentarily on the boundary line of the upper half and the lower half of the panel can be avoided.

14 Claims, 17 Drawing Sheets

Fig. 9

| | RESET PERIOD | PRECHARGE PERIOD | LIGHTING SCAN PERIOD | NON-LIGHTING SCAN PERIOD |
|---|---|---|---|---|
| DATA LINE SIDE | Vm or GND | Vr (PRECHARGE) | Vf (CONSTANT CURRENT) | GND |
| SELECTED SCAN LINE | ———— | GND | GND | ———— |
| NON-SELECTED SCAN LINE | Vm or GND | Vm (REVERSE BIAS) | Vm (REVERSE BIAS) | Vm (REVERSE BIAS) |

SELF LIGHT EMITTING DISPLAY PANEL AND DRIVE CONTROL METHOD THEREFOR

BACKGROUND OF THE INVENTION

1. Field of the Invention

The present invention relates to a self light emitting display panel of a passive matrix drive method and a drive control method therefor in which for example organic EL (electroluminescent) elements are employed as light emitting elements and in which a display panel is divided into two display areas to perform dual scan display.

2. Description of the Related Art

Due to spread of cellular phones, personal digital assistants (PDAS), and the like, demand for a display panel which has a high definition image display function and which can realize a thin shape and low power consumption is increasing, and conventionally a liquid crystal display panel has been adopted in many products as a display panel which satisfies its needs. Meanwhile, these days an organic EL element which makes the best use of a characteristic being a self light emitting type display element has been employed for a manufactured product, and this has attracted attention as a next generation display panel instead of the conventional liquid display panel. This is because of backgrounds one of which is that by employing, in a light emitting layer of the element, an organic compound which enables an excellent light emission characteristic to be expected, a high efficiency and a long life which can be equal to practical use have been advanced.

The organic EL element is constructed basically in such a way that a transparent electrode for example by ITO, an organic EL medium, and a metallic electrode are laminated one by one on a transparent substrate such as glass or the like. The organic EL medium may be a single layer of an organic light emitting layer, a medium of double layer structure composed of an organic positive hole transport layer and an organic light emitting layer, a medium of a triple layer structure composed of an organic positive hole transport layer, an organic light emitting layer, and an organic electron transport layer, or a medium of a multilayer structure in which an injection layer of electron or positive hole is inserted into an appropriate portion among these layers.

The above-described organic EL element can be electrically replaced by a structure composed of a light emitting component having a diode characteristic and a parasitic capacitance component which is connected in parallel-to-this light emitting component, and thus the organic EL element can be said to be a capacitive light emitting element. When a light emission drive voltage is applied to this organic EL element, at first, electrical charges corresponding to the electric capacity of this element flow into the electrode as a displacement current and are accumulated. It can be considered that when the drive voltage then exceeds a determined voltage (light emission threshold voltage=Vth) peculiar to this element, current begins to flow from one electrode (anode electrode side of the diode component) to an organic layer constituting the light emitting layer so that the element emits light at an intensity proportional to this current.

Regarding the organic EL element, due to reasons that the voltage-intensity characteristic thereof is unstable with respect to temperature changes while the current-intensity characteristic thereof is stable with respect to temperature changes and that degradation of the organic EL element is considerable when the organic EL element receives an excess current so that light emission lifetime is shortened, a constant current drive is performed in general. As display panels in which such organic EL elements are employed, a passive drive type display panel in which the elements are arranged in a matrix pattern has already been put into practical use in some products.

FIG. 1 shows a basic structure of a conventional passive matrix type display panel and a drive circuit therefor. Regarding drive methods for organic EL elements in this passive matrix drive method, there are two methods of cathode line scan/anode line drive and anode line scan/cathode line drive, and the structure shown in FIG. 1 shows a form of the former cathode line scan/anode line drive. That is, anode lines A1–Am as m data lines are arranged in a vertical direction, cathode lines K1–Kn as n scan selection lines are arranged in a horizontal direction, and organic EL elements E11–Emn designated by symbols/marks of diodes are arranged at portions at which the anode lines intersect the cathode lines (in total, m×n portions) to construct a display panel 1.

In the respective EL elements E11–Emn constituting pixels, one ends thereof (anode terminals in the equivalent diodes of the EL elements) are connected to the anode lines and the other ends thereof (cathode terminals in the equivalent diodes of the EL elements) are connected to the cathode lines, corresponding to the respective intersection positions between the anode lines A1–Am extending along the vertical direction and the cathode lines K1–Kn extending along the horizontal direction. Further, one end portions of the respective anode lines A1–Am are connected to a data driver 2, and one end portions of the respective cathode lines K1–Kn are connected to a scan driver 3, so as to be driven respectively.

The scan driver 3 allows the cathode lines K1–Kn connected thereto to connect for example to a reference potential point (ground) sequentially alternatively, and the data driver 2 operates to allow pixels by the EL elements to emit light selectively by appropriately supplying light emission drive current to the respective anode lines A1–Am in synchronization with the scan selection.

Meanwhile, in a display panel by this type of passive matrix drive method, as a panel size is increased, a line resistance or line capacitance increases, and thus a RC response time increases. Since a signal delay due to the increase of the RC response time not only deteriorates response (response operation) of image display in a display but also delays the time until the voltage reaches a light emission threshold voltage during the scan time in respective light emission elements, it causes a substantial light emission intensity of the display to be decreased. In order to solve such a problem, dual scan in which for example a display panel is divided into two sections, the upper and lower, and in which respective display panels are scanned simultaneously, that is, a dual scan method, has been proposed.

In a case where the dual scan method is adopted, since scanning operations for two divided display panels can be respectively implemented simultaneously, the scan time for each scan line can be set to a longer period of time, and a light emission time rate (light emission duty) of a light emitting element can be increased. Therefore, even when drive current given to a light emitting element is decreased to decrease momentary light emission intensity of the element, the brightness of a display screen can be ensured satisfactorily. The dual scan drive method is disclosed in Japanese Patent Application Laid-Open No. 2003-302937 shown below.

FIG. 2 shows examples of operations of cases where the dual scan drive method is adopted, and as this dual scan drive method, scan control methods shown in FIG. 2A or FIG. 2(B) have been considered. In FIG. 2A or FIG. 2(B), n scan lines (n is a natural number of a multiple of 2) arranged on a panel are divided into an upper half and a lower half to constitute display panels 1A and 1B.

In FIG. 2, as scan lines respectively counted from the top are represented by numbers on right sides of the respective display panels 1A and 1B, the upper half of the panel 1A has scan lines from a first scan line to a (n/2)th scan line, and these are driven to emit light by unillustrated data driver and scan driver corresponding to the upper half of the panel 1A. The lower half of the panel 1B has scan lines from a (n/2+1)th scan line to an nth scan line, and these are driven to emit light by unillustrated similar data driver and scan driver (not shown) corresponding to the lower half of the panel 1B.

Here, in the scan control method shown in FIG. 2A, the first through (n/2)th scan lines of the upper half are scanned from the first line toward the (n/2)th line sequentially, and at the same time the (n/2+1)th through nth scan lines of the lower half are scanned from the (n/2+1)th line toward the nth line sequentially. That is, the arrows shown in a left side in FIG. 2A show a scan direction for scanning the respective panels of the upper half and the lower half.

The scan control method shown in FIG. 2(B) shows an example for scanning the respective panels in a reverse direction with respect to the direction described above. That is, in the scan control method shown in FIG. 2(B), the first through (n/2)th scan lines of the upper half are scanned from the (n/2)th line toward the first line sequentially, and at the same time the (n/2+1)th through nth scan lines of the lower half are scanned from the nth line toward the (n/2+1)th line sequentially. That is, the arrows shown in a left side in FIG. 2(B) show a scan direction for scanning the respective panels of the upper half and the lower half.

Meanwhile, even when any of the scan control methods shown in FIGS. 2(A) and 2(B) is adopted, in a case where a figure laid across the upper half and the lower half is displayed to move fast for example in a horizontal direction, trouble as described below occurs. FIG. 3 shows an example of a case where the respective panels 1A, 1B of the upper half and the lower half are simultaneously scanned in a downward direction from the top as shown in FIG. 2A. FIG. 3A shows a state in which a blocky figure F displayed to be laid across the upper half and the lower half is being displayed on the right side of the screen, and FIG. 3B shows a condition that in a next frame the blocky figure F is moved to a central portion of the screen to be displayed as shown by the outlined arrow.

FIG. 4 schematically explains movements of lit pixels with respect to the respective scan lines resulting from a moving representation of the blocky figure F as shown in FIG. 3 and is schematic views of the lit pixels regarding which the vicinity of the boundary laid across the upper half and the lower half is enlarged and shown. FIGS. 4A to 4G show the movements of the lit pixels during one frame period. Since a display panel employing self light emitting elements represented by the above-mentioned organic EL elements for pixels has a so-called normally black characteristic, although normally a non-illuminating state is shown by black and an illuminating state is shown by white, the relationship of the black and white is reversed and shown in FIG. 4 for convenience of illustration.

FIG. 4A shows a state in which the blocky figure F is displayed on the right side of the screen as shown in FIG. 3A. In the state shown in this FIG. 4A, upon the start of scanning, since scanning of the first line in the lower half of the panel, that is, the (n/2+1)th line, is first implemented, pixels on the (n/2+1)th line are moved to a central portion of the screen to be lit as shown by the outlined arrow in FIG. 4B. Next, since scanning of the (n/2+2)th line is implemented, pixels on the (n/2+2)th line are moved to a central portion of the screen to be lit as shown by the outlined arrow in FIG. 4C.

Further, similarly, since scanning of the (n/2+3)th line is implemented in the next step, pixels on the (n/2+3)th line are moved to a central portion of the screen to be lit as shown by the outlined arrow in FIG. 4D. During the period of FIGS. 4A to 4D described above, since the first through third lines are scanned sequentially from the top in the upper half of the panel, lit pixels in the vicinity of the boundary in the upper half of the screen do not move to a central portion of the screen.

At the time of the state shown in FIG. 4E in the vicinity of the end of one frame as scanning for each line progresses, since scanning the (n/2−2)th line in the upper half is implemented, here, for the first time, lit pixels in the upper half are moved to a central portion of the screen to be lit as shown by the outlined arrow. Following that, since scanning the (n/2−1)th line in the upper half of the panel is implemented, pixels on the (n/2−1)th line are moved to a central portion of the screen to be lit as shown by the outlined arrow in FIG. 4F.

Further, since scanning the (n/2)th line is implemented at the end of one frame period, pixels on the (n/2)th line are moved to a central portion of the screen to be lit as shown by the outlined arrow in FIG. 4G. Thus, as shown in FIG. 3B, the blocky figure F is moved to a central portion of the screen to be displayed.

As is apparent from the description above, a period from the completion of the movement of the lit pixels displayed on the lower half of the panel as shown in FIG. 4D to the start of the movement of the lit pixels displayed on the upper half of the panel as shown in FIG. 4E requires a period close to one frame. Since this is recognized as an after image in human vision, the figure is recognized with a sense of incompatibility that the figure is divided into two although the figure is one blocky figure. Although a relatively simple operation of a case where a blocky figure is moved from a right end to a central portion of a screen is exemplified in the description above, in reality complex figure changes such as a movement further to a left side of the screen or rapid reciprocating movements may occur. In such a case, the above-described sense of incompatibility may be perceived further considerably.

Thus, in order to prevent the above-described sense of incompatibility from occurring, as shown in FIG. 5, it can be considered to adopt a means for scanning the first through (n/2)th scan lines from the first line to the (n/2)th line sequentially (that is, from the upper end to the center of the screen) in the upper half of the panel and at the same time for scanning the (n/2+1)th through nth scan lines from the nth line to the (n/2+1)th line sequentially (that is, from the lower end to the center of the screen) in the lower half of the panel. The arrows displayed on a left side in FIG. 5A show scan directions for scanning the respective upper half and lower half of the panel.

FIGS. 5A to 5D show states in which during a period of one frame as shown in FIG. 3 the blocky figure F which is displayed so as to be laid across the upper half-and the lower half is moved from the right side to the central portion of the screen to be displayed similarly to the example already described. That is, FIGS. 5A to 5D show movements of lit pixels during the period of one frame.

According to the scan method shown in FIG. 5, until a time just before the completion of one frame period, as shown in FIG. 5A, there is no movement of lit pixels in the upper half and lower half of the panel. Immediately before the completion of scanning, as shown in FIG. 5B, since the (n/2−2)th line in the upper half of the panel and the (n/2+3)th line in the lower half of the panel are simultaneously scanned, pixels of the lines corresponding to these are respectively moved to the central portions of the screen to be lit.

At the next scan timing, as shown in FIG. 5C, pixels of the (n/2−1)th line in the upper half of the panel and the (n/2+2)th line in the lower half of the panel are simultaneously moved to the central portions to be lit. Similarly, at a scan timing of the end of one frame, as shown in FIG. 5D, pixels of the (n/2)th line in the upper half of the panel and the (n/2+1)th line in the lower half of the panel are simultaneously moved to the central portions to be lit.

Although there occurs a state in which one blocky figure F is divided in a time domain so that divided ones move on the screen even when the scan method shown in FIG. 5 is adopted, a time period required for the movement of the entire block becomes an extremely short time compared to the case where the scan method shown in FIG. 4 already described is adopted. Accordingly, an afterimage effect in human vision is hard to occur, and a problem that a sense of incompatibility occurs as in the example shown in FIG. 4 can be resolved.

Meanwhile, in the case where the scan method shown in FIG. 5 is adopted, the lowermost scan line (the (n/2)th scan line) in the upper half of the panel and the uppermost scan line (the (n/2+1)th scan line) in the lower half of the panel are brought to a scan selection state simultaneously. That is, the pixels on the vertically adjoining scan lines emit light. In such a case, there occurs a problem that the two scan lines are recognized as a line brighter than normal in human vision.

Japanese Patent Application Laid-Open No. 2003-302937 shown earlier as a prior art reference describes that momentarily intense light is emitted in the case where scanning is implemented in the same direction in the upper half and the lower half of the panel, that is, in the case where the scan method shown in FIG. 2A or 2(B) already described is adopted. However, the ground thereof is not made clear. Yet, the occurrence of bright line corresponds to the case as shown in FIG. 5 in which the scan method in which a central portion is treated as an axis of symmetry is adopted, and the present inventors have confirmed in experiments that in the case where adjacent scan lines are in the scan selection state, light emission is recognized further extensively in human vision.

SUMMARY OF THE INVENTION

The present invention has been developed based on the above-described technical viewpoint, and it is an object of the present invention to provide a self light emitting display panel and a drive control method therefor which revolve a problem that a bright line is generated momentarily on the boundary line between an upper half and lower half thereof and which can effectively resolve occurrence of a sense of incompatibility recognized by an afterimage of human vision in a case where a figure displayed to be laid across the upper half and the lower half moves rapidly in a horizontal direction as already described above in a display panel of a passive matrix drive method performing dual scan display.

A self light emitting display panel according to the present invention which has been developed to solve the above problems is, as described in claim 1, a passive matrix type self light emitting display panel which has a first display area and a second display area to perform dual scan display and which is constructed to allow a data driver to give display data to self light emitting elements arranged in the respective display areas and to allow scan selection operations of the first and second display areas to be sequentially performed in synchronization with each other by a scan driver, characterized by comprising a scanning means for controlling a start time of the scan selection operation of the first display area and a start time of the scan selection operation of the second display area in each frame period such that the difference between the start time of the scan selection operation of the first display area and the start time of the scan selection operation of the second display area is scanning time of at least one or more scan lines.

A drive control method for a self light emitting display panel according to the present invention which has been developed to solve the above problems is, as described in claim 6, a drive control method for a passive matrix type self light emitting display panel which has a first display area and a second display area to perform dual scan display and which is constructed to allow a data driver to give display data to self light emitting elements arranged in the respective display areas and to allow scan selection operations of the first and second display areas to be sequentially performed in synchronization with each other by a scan driver, characterized by controlling a start time of the scan selection operation of the first display area and a start time of the scan selection operation of the second display area in each frame period such that the difference between the start time of the scan selection operation of the first display area and the start time of the scan selection operation of the second display area is scanning time of at least one or more scan lines.

BRIEF DESCRIPTION OF THE DRAWINGS

FIG. 9 is a view showing a relationship of respective electrical potentials applied to data lines and scan lines during respective periods shown in FIG. 8;

DESCRIPTION OF THE PREFERRED EMBODIMENTS

Figure 1:
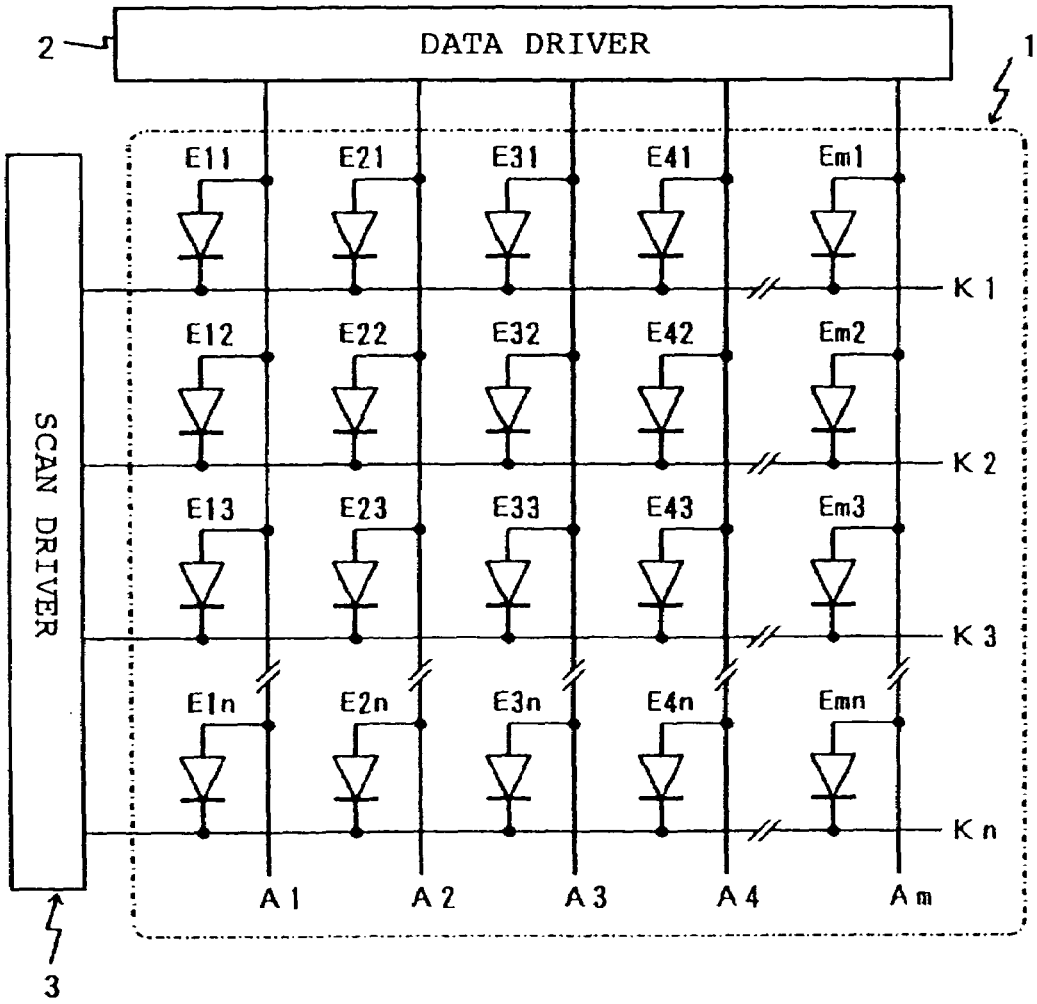
Fig. 1 PRIOR ART
FIG. 1 is a connection diagram showing one example of a passive matrix type display panel and a drive circuit therefor.
Figure 2A:
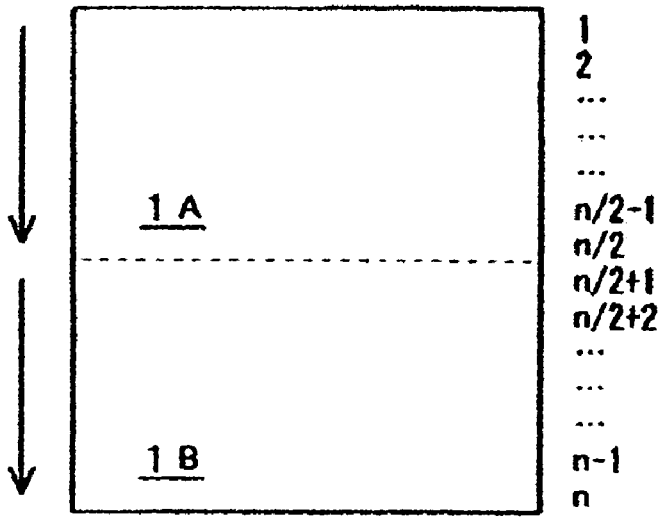
Fig. 2A PRIOR ART
FIGS. 2A, 2B are schematic views showing examples of scanning of a case where a dual scan drive method is adopted.
Figure 2B:
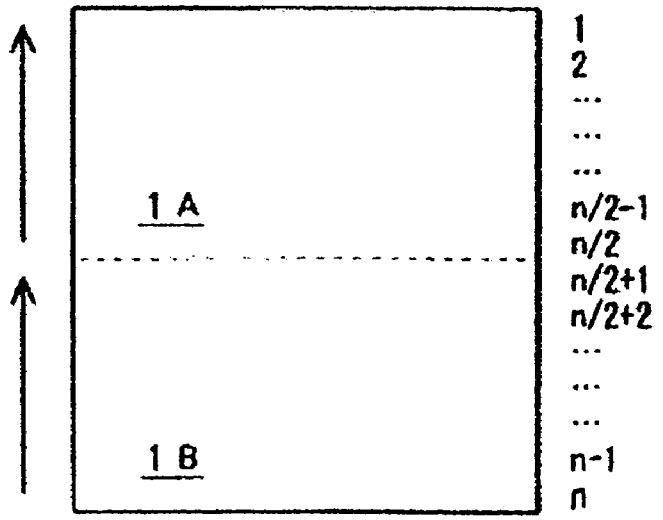
Fig. 2B PRIOR ART
Figure 3A:
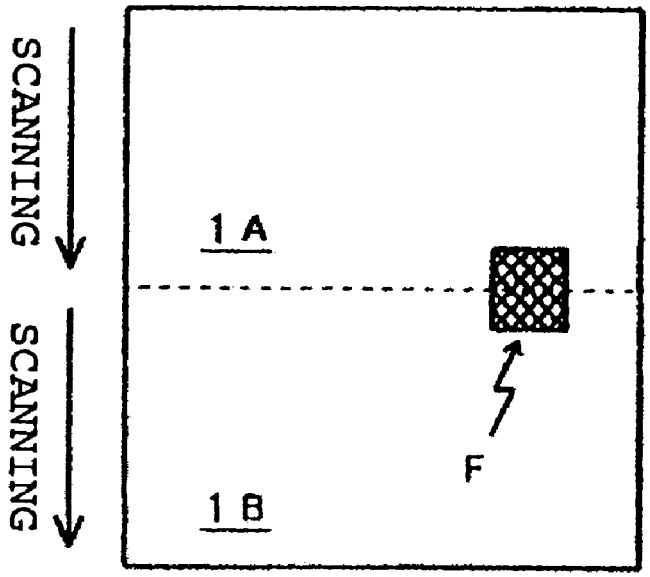
Fig. 3A PRIOR ART
FIGS. 3A, 3B are schematic views showing an example in which similarly a dual scan drive method is adopted and in which a blocky figure is displayed to be laid across an upper half and a lower half of a screen.
Figure 3B:
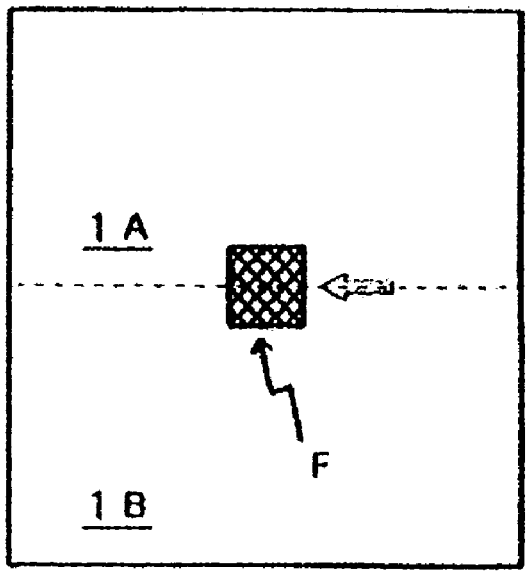
Fig. 3B PRIOR ART
Figure 4A:
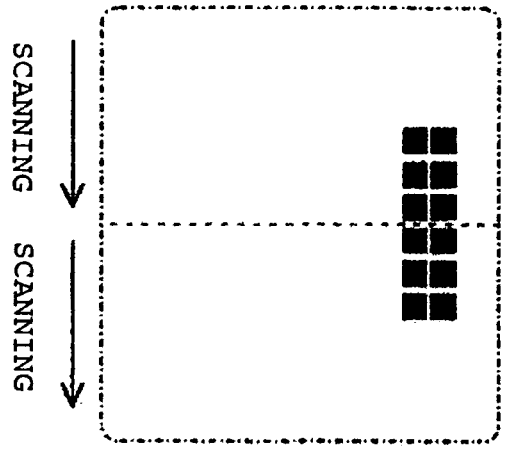
Fig. 4A PRIOR ART
FIGS. 4A, 4B, 4C, 4D, 4F, 4G are schematic views explaining movements of lit pixels for each scan line resulting from a moving display of the figures shown in FIGS. 3A and 3B.
Figure 4B:
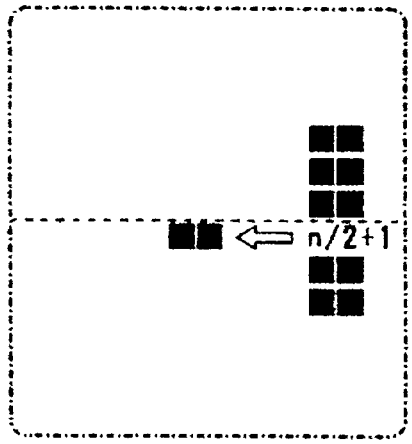
Fig. 4B PRIOR ART
Figure 4C:
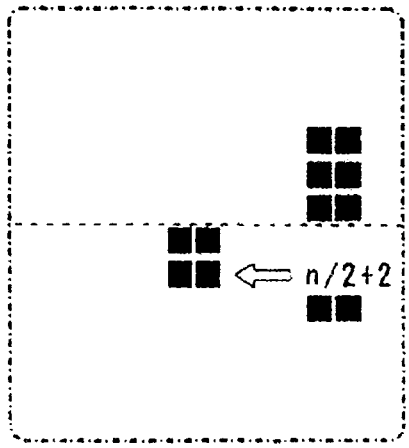
Fig. 4C PRIOR ART
Figure 4D:
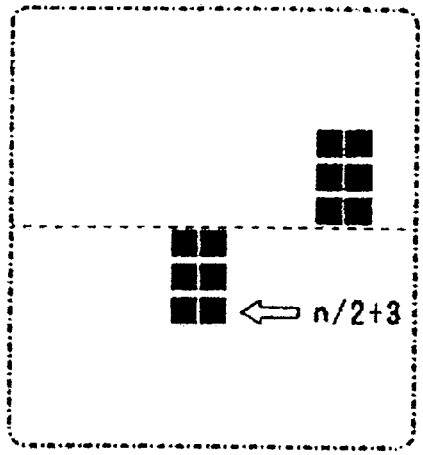
Fig. 4D PRIOR ART
Figure 4E:
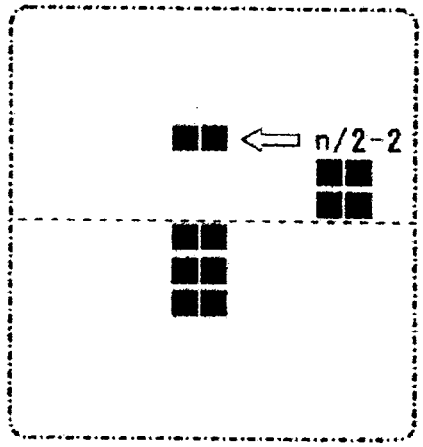
Fig. 4E PRIOR ART
Figure 4F:
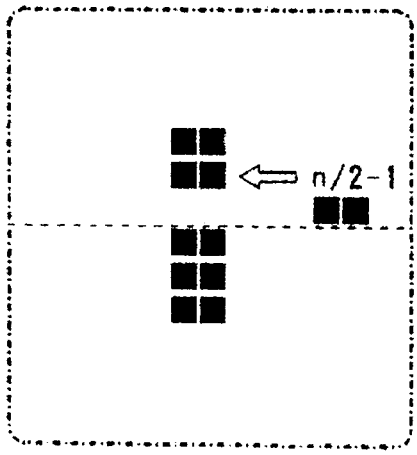
Fig. 4F PRIOR ART
Figure 4G:
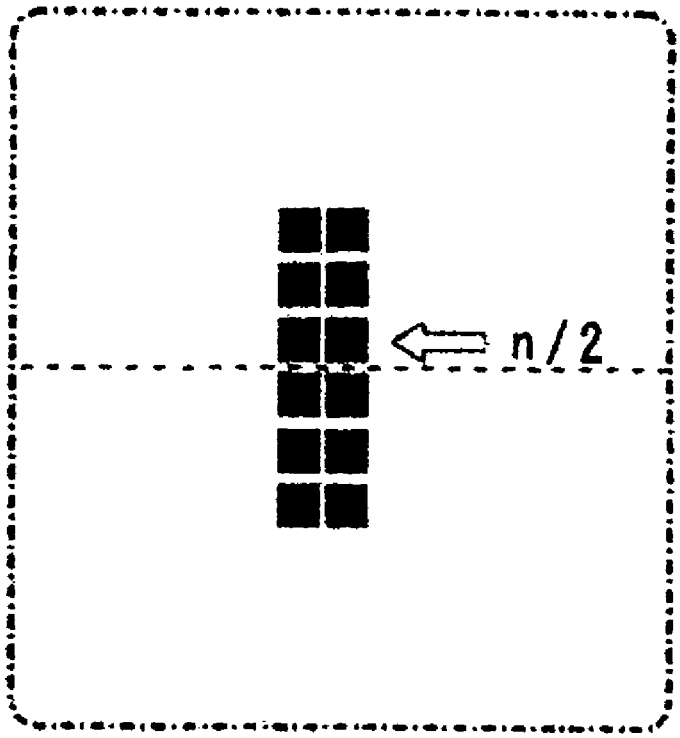
Fig. 4G PRIOR ART
Figure 5A:
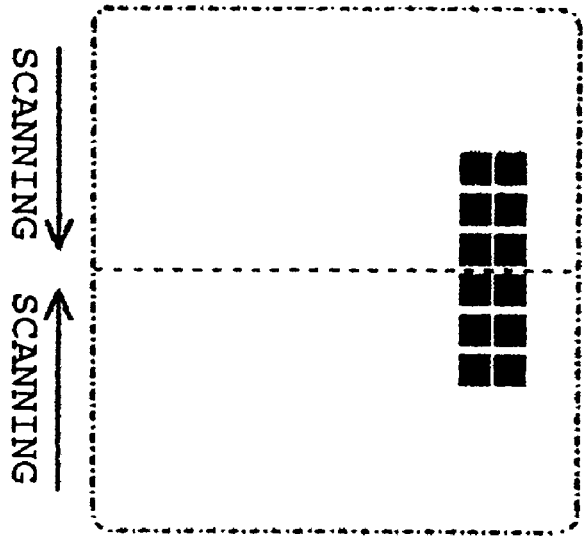
Fig. 5A PRIOR ART
FIGS. 5A, 5B, 5C, 5D are schematic views showing an example to resolve unnaturalness of the movement of the lit pixels shown in FIGS. 4A, 4B, 4C, 4D, 4F, and 4G by changing the scan direction.
Figure 5B:
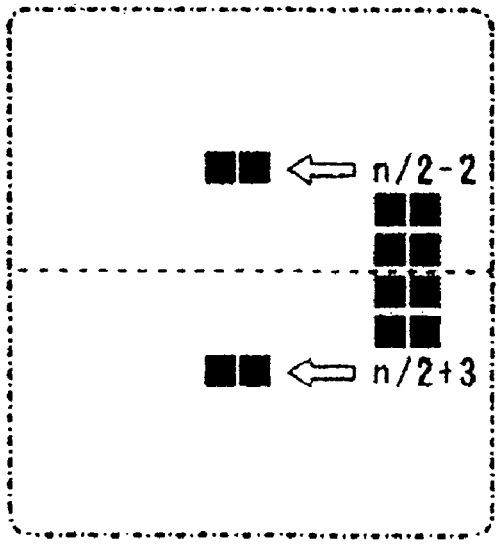
Fig. 5B PRIOR ART
Figure 5C:
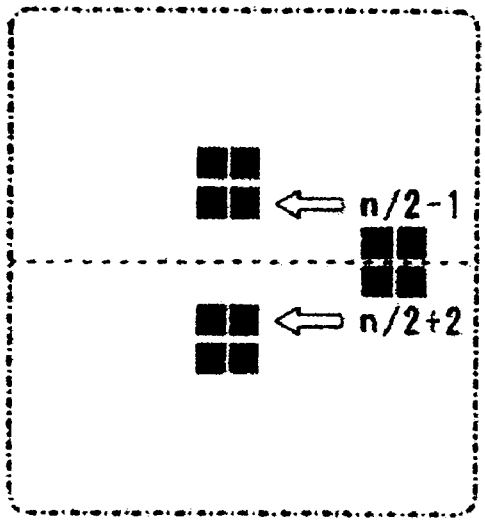
Fig. 5C PRIOR ART
Figure 5D:
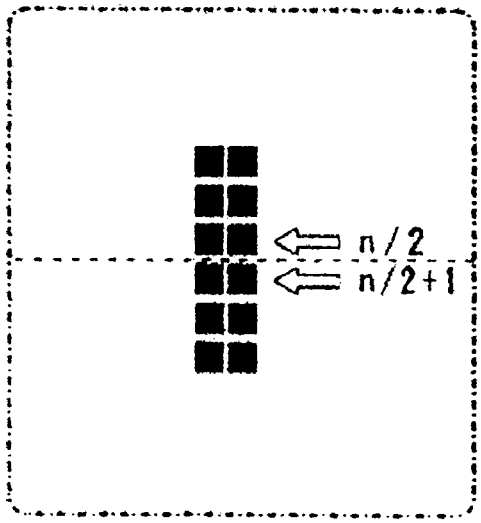
Fig. 5D PRIOR ART

A passive matrix type self light emitting display panel and a drive control method therefor according to the present invention will be described below based on the embodiments shown in the drawings. FIGS. 6(A)–(F) show a first embodiment in which a drive control method according to the present invention is adopted and shows a most basic drive control method. FIGS. 6(A)–(F) sequentially show scan states in one frame, and in FIGS. 6(A)–(F), in an upper half and a lower half, that is, in a first display area and a second display area, dual scan display is performed as already described.

Figure 6A:
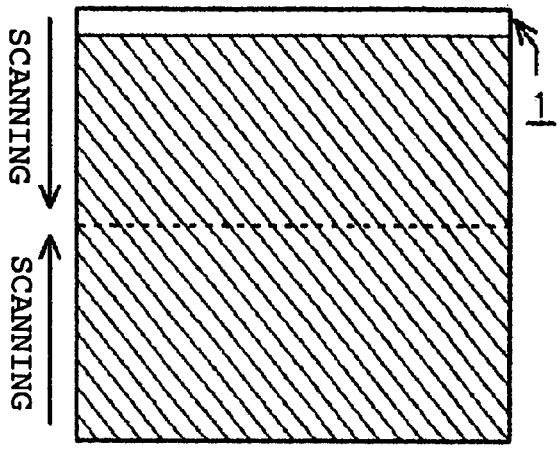
FIGS. 6A, 6B, 6C, 6D, 6F are schematic views explaining scan states in a first embodiment according to the present invention.

In this case, as shown by the arrows in FIG. 6A, adopted is a means for implementing scanning in such a way that the scan selection operation direction of the first display area and the scan selection operation direction of the second display area are different from each other. That is, adopted is a means for scanning the first to (n/2)th scan lines from the first line to the (n/2)th line sequentially (that is, from the upper end to the center of the screen) in the upper half of the panel and at the same time for scanning the (n/2+1)th through nth scan lines from the nth line to the (n/2+1)th line sequentially (that is, from the lower end to the center of the screen) in the lower half of the panel.

Further, in the embodiment shown in FIGS. 6(A)–(F), the difference between the start time of a scan selection operation in the upper half of the panel and the start time of the scan selection operation in the lower half of the panel in each frame period is controlled to be the scanning time of one scan line. In FIGS. 6A to 6F, a line(s) on which the scan selection operation is performed, that is, a scan line(s), are shown by a white portion(s) against the black background, and the line number(s) of the scan line(s) are shown on the right side thereof.

Figure 6B:
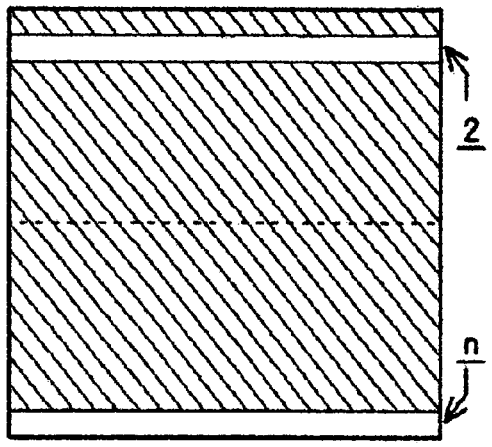

First, at the start time of one frame period, as shown in FIG. 6A, the first line in the upper half of the panel is scanned. At this time, in the lower half of the panel, any lines are not scanned. At the next scan timing, as shown in FIG. 6B, the second line in the upper half of the panel is scanned, and the nth line in the lower half of the panel is scanned. In this manner, the difference between the start time of the scan selection operation in the upper half of the panel and the start time of the scan selection operation in the lower half of the panel is set to the scanning time of one scan line.

Figure 6C:
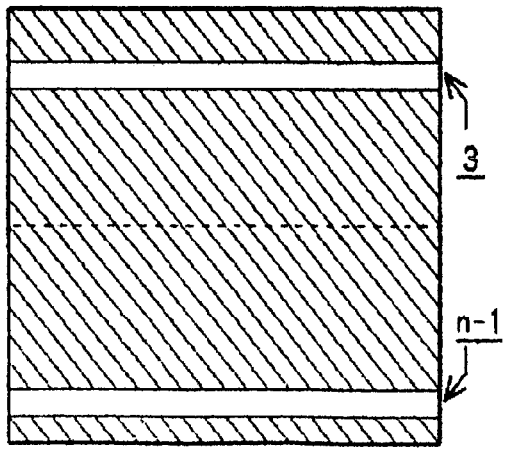

Further, at the next scan timing, as shown in FIG. 6C, the third line in the upper half of the panel is scanned, and the (n−1)th line in the lower half of the panel is scanned. As described above, in the respective upper and lower halves of the panel, scan selection operations are performed sequentially in synchronization with the scan timing.

Figure 6D:
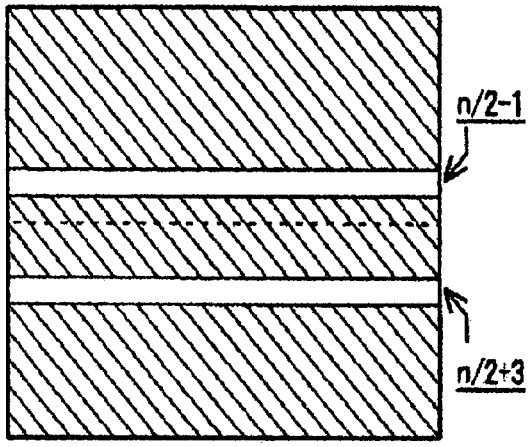
Figure 6E:
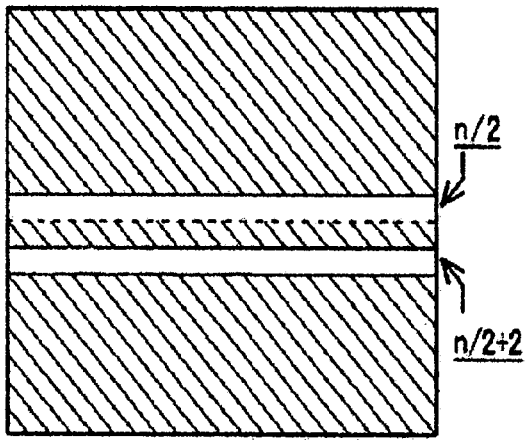

FIG. 6D and following drawings explain scan states immediately before the completion of one frame period. That is, in FIG. 6D, the (n/2−1)th line in the upper half of the panel is scanned, and at this time the (n/2+3)th line is scanned in the lower half of the panel. At the next scan timing, as shown in FIG. 6E, the (n/2)th line in the upper half of the panel is scanned, and at the same time the (n/2+2)th line in the lower half of the panel is scanned.

Figure 6F:
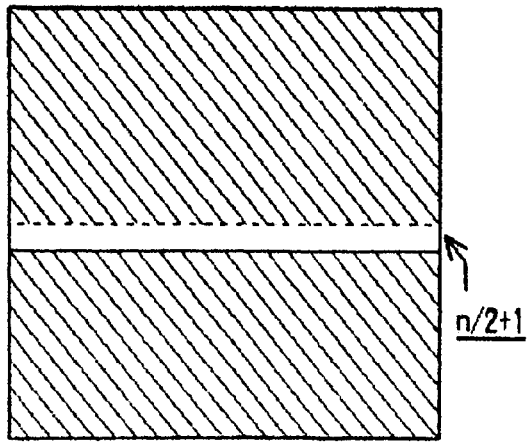

At a final scan timing of one frame period, as shown in FIG. 6F, in the upper half of the panel, a scanning operation has already been completed, and any of lines are not scanned. At this time, in the lower half of the panel, the (n/2+1)th final line is scanned. Summarizing, the scan states described above can be shown as the following Table 1. In Table 1, description of "none" represents a state in which any lines are not scanned in the upper half or the lower half of the panel.

TABLE 1

| | scan line | |
|---|---|---|
| scan timing | upper half | lower half |
| a | 1 | None |
| b | 2 | N |
| c | 3 | n − 1 |
| . . . | . . . | . . . |
| d | n/2 − 1 | n/2 + 3 |
| e | n/2 | n/2 + 2 |
| f | None | n/2 + 1 |

In the case where the above-described scan method is adopted, adjacent scan lines are not simultaneously brought to a scan selection state, and thus a problem that a bright line is generated momentarily on the boundary line of the upper half and the lower half of the panel can be avoided. Since the direction of the scan selection operation of the upper half of the panel and the direction of the scan selection operation of the lower half of the panel are different from each other, the time gap of scan timings close to the boundary line of the upper half and the lower half of the panel can be decreased, and occurrence of sense of incompatibility recognized by an afterimage of human vision as already described can be resolved effectively.

Meanwhile, in the case where the above-described scan method is adopted, as shown by "none" in Table 1, in one frame period, a state in which any lines in the upper or the lower half of the panel are not scanned occurs. Thus, it is possible to adopt a means for applying a reverse bias voltage to all EL elements in the upper half or the lower half of the panel while positively utilizing the period of "none". In the case where the reverse bias voltage is applied periodically to the EL elements in this manner, it is known that the light emission lifetimes of the EL elements can be prolonged (for example, see Japanese Patent Application Laid-Open No. 2004-70057 and Japanese Patent Application Laid-Open No. 2002-169510).

Figure 7:
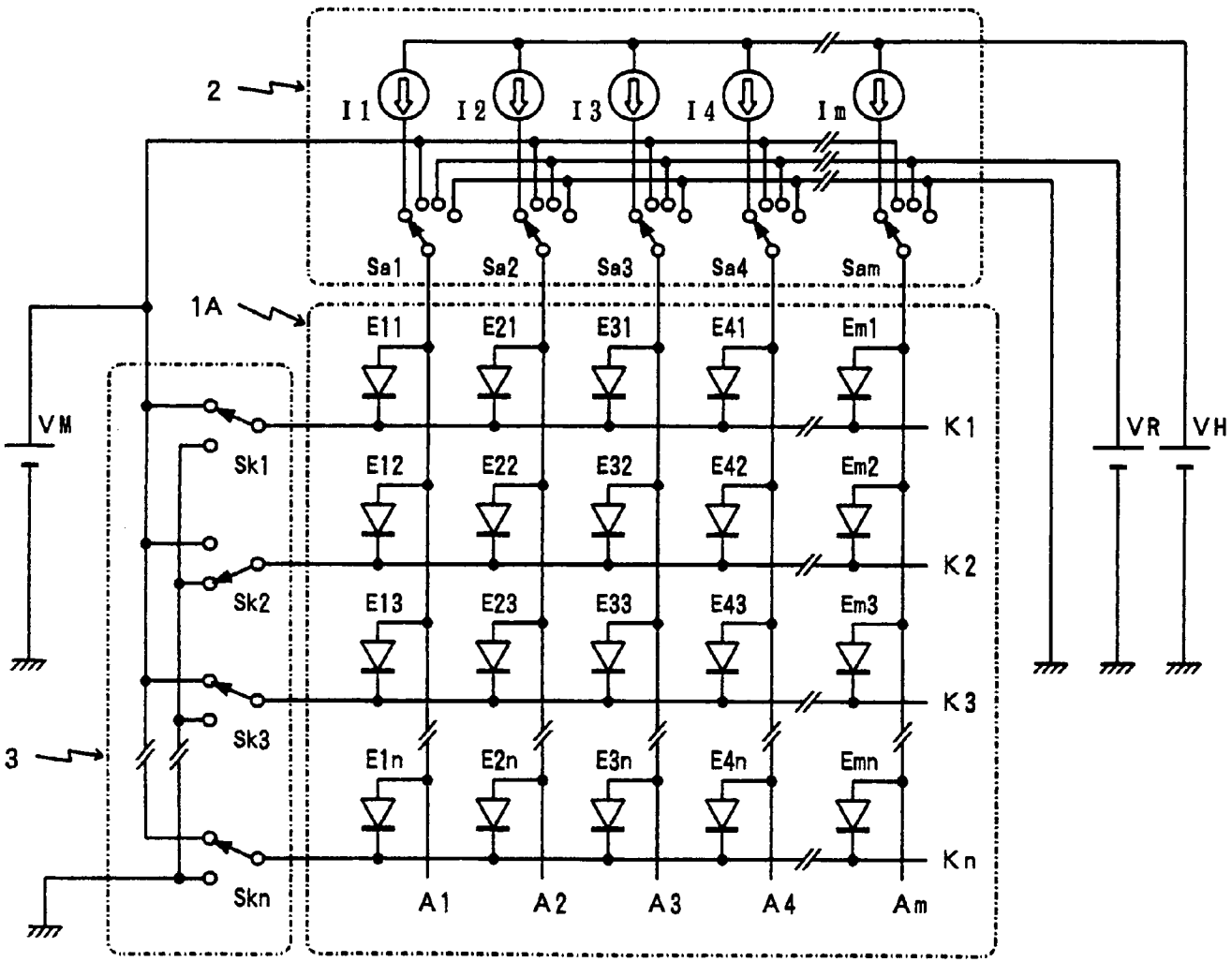
FIG. 7 is a circuit structure diagram showing an example of a display panel and a drive circuit therefor which can be adopted in the embodiment shown in FIGS. 6A, 6B, 6C, 6D, 6F.

FIG. 7 shows an example of a structure of a passive matrix type display panel which can apply a reverse bias voltage which does not contribute to a light emission operation and a drive circuit therefor (a data driver 2 and a scan driver 3). The structure shown in FIG. 7 shows an example of one side of the display panel utilized in a dual scan display method (for example, the upper half of a display panel 1A) and a drive circuit therefor, and the other side of the display panel and a drive circuit therefor are constructed similarly to the structure shown in FIG. 7. The structure of the upper half of the display panel 1A shown in FIG. 7 is the same as that of the display panel 1 shown in FIG. 1 already described, and therefore detailed description thereof will be omitted.

In the data driver 2 in FIG. 7, provided are constant current sources I1–Im operating utilizing a drive voltage Vh supplied from a drive voltage source VH and drive switches Sa1–Sam, and by allowing the drive switches Sa1–Sam to be connected to the constant current sources I1–Im sides, current from the constant current sources I1–Im is supplied as drive current to respective EL elements E11–Emn arranged corresponding to anode lines A1–Am. The drive switches Sa1–Sam are constructed such that a reverse bias voltage Vm from a reverse bias voltage source VM, a precharge voltage Vr from a precharge voltage source VR, or a ground potential GND as a reference potential point is supplied to the respective EL elements E11–Emn arranged corresponding to the anode lines.

Meanwhile, in the scan driver 3, scan switches Sk1–Skn are provided corresponding to respective cathode lines K1–Kn to operate to allow either the reverse bias voltage Vm from the reverse bias voltage source VM which is for preventing crosstalk light emission and the like or the ground potential GND as the reference potential point to be connected to corresponding cathode lines.

Control signals are respectively supplied to the data driver 2 and the scan driver 3 via a control bus from a light emission control circuit including an unillustrated CPU, and based on a video signal to be displayed, switching operations of the scan switches Sk1–Skn and the drive switches Sa1–Sam are performed. Thus, the constant current sources I1–In are connected to desired anode lines while the cathode scan line is set at the ground potential at a predetermined cycle based on the video signal, and the respective EL elements E11–Emn are selectively illuminated, so that an image based on the video signal is displayed on the display panel 1.

In the state shown in FIG. 7, the second cathode line K2 is set at the ground potential to become in a scan state, and at this time the reverse bias voltage Vm from the reverse bias voltage source VM is applied to the respective cathode lines K1, K3–Km of a non-scan state. Here, where the forward voltage of the EL element in a scan light emission state is Vf, respective potentials are set to establish a relationship of [(forward voltage Vf)−(reverse bias voltage Vm)]<(light emission threshold voltage Vth), and thus the respective EL elements connected to intersection points between driven anode lines and cathode lines which are not selectively scanned are prevented from emitting crosstalk light.

Meanwhile, the organic EL elements arranged in the display panel 1A respectively have a parasitic capacitance as described above, and these elements are arranged at intersection positions between the anode lines and the cathode lines in a matrix pattern. Thus, for example, in an example of a case where several tens of EL elements are connected to one anode line, with respect to the anode lines, a synthesized capacitance of several hundred times the each parasitic capacitance or greater is connected to the anode lines as a load capacitance. This synthesized capacitance increases drastically as the size of the matrix increases.

Therefore, at a beginning of a lighting scan period of EL elements, current from the constant current sources I1–Im provided via the anode lines is consumed for charging the synthesized load capacitance, and a time lag occurs for charging the load capacitance until the voltage satisfactorily exceeds the light emission threshold voltage (Vth) of the EL element. Therefore, there occurs a problem that a rise of lighting of the EL element delays (slows down). In particular, in the case where the constant current sources I1–Im are employed as drive sources for the EL elements as described above, since the constant current source is a high impedance output circuit on the principle of operation, the current is restricted so that the rise of lighting of the EL element delays drastically.

This deteriorates the lighting time rate of the EL element, and thus there is a problem that the substantial light emission intensity of the EL element is decreased. Thus, in order to eliminate the delay of the rise of lighting of the EL element by the parasitic capacitance, a precharge voltage source VR is provided in the structure shown in FIG. 1.

Figure 8:
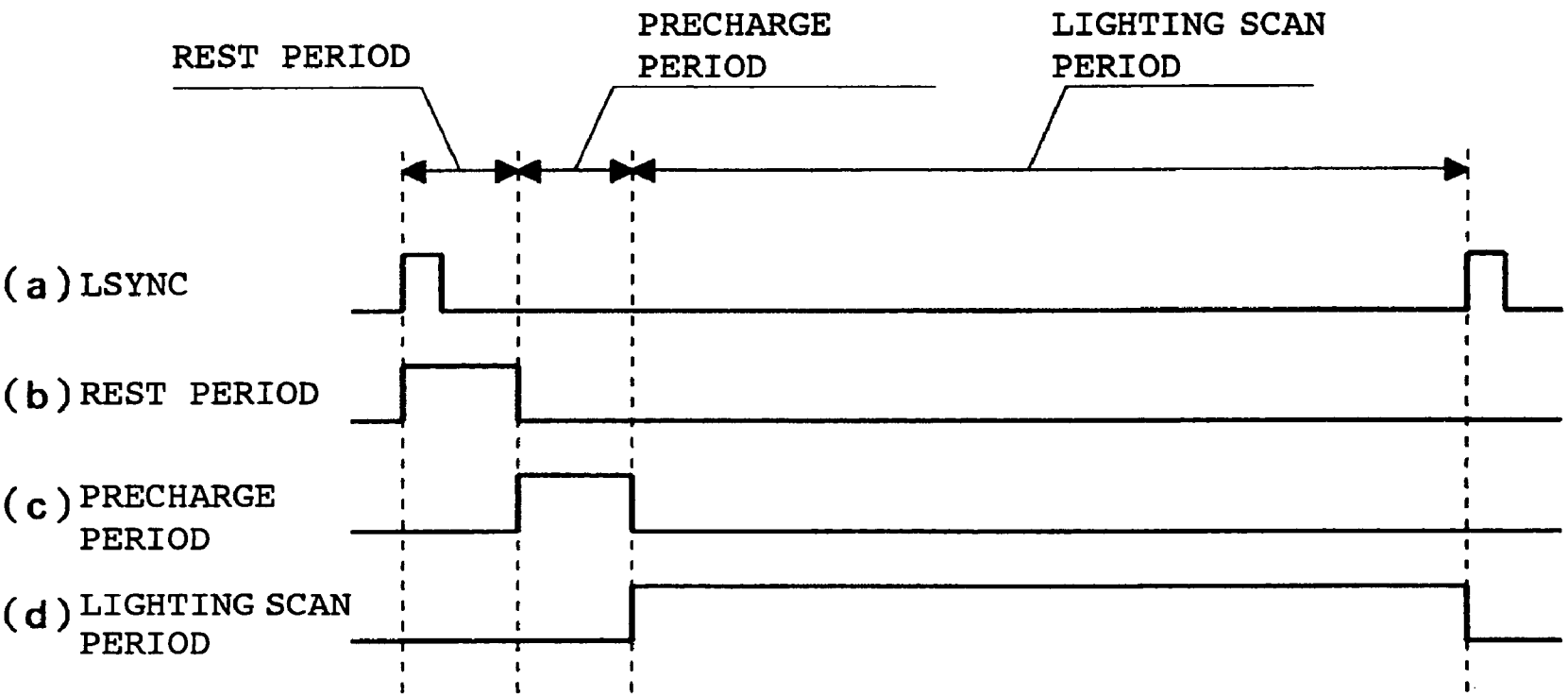
FIG. 8 is timing chart showing a lighting drive operation in the circuit structure shown in FIG. 7.

FIG. 8 is a timing chart showing a lighting drive operation of the EL element including a precharge period for charging electrical charges in the parasitic capacitance of the EL element, employing the voltage Vr by the precharge voltage source VR. FIG. 9 is a view showing a relationship of respective potentials applied to data lines (anode lines) and scan lines (cathode lines) during respective periods. "Non-lighting scan period" shown in FIG. 9 shows for example a state in which any lines of the upper half of the panel 1A are not scanned during one frame period, that is, a period described by "none" in Table 1.

Reference character (a) in FIG. 8 denotes a scan synchronization signal, and in this example as shown in FIG. 8B a reset period is first set in synchronization with the scan synchronization signal. This reset period is set to discharge electrical charges accumulated in the parasitic capacitances of respective EL elements arranged in the display panel 1A. During this reset period, the reverse bias voltage Vm from the reverse bias voltage source VM or the ground potential GND is supplied to all of the data lines and scan lines as shown in FIG. 9.

That is, in FIG. 7, the drive switches Sa1–Sam are connected to the reverse bias voltage source VM side, and the reverse bias voltage Vm is applied to the respective data lines A1–Am. At this time, the scan switches Sk1–Skn also are connected to the reverse bias voltage source VM side, and the reverse bias voltage Vm is applied to the respective scan lines K1–Kn. Accordingly, electrical charges accumulated in the parasitic capacitances of the respective EL elements on the display panel 1A are discharged and become in a reset state. In the structure shown in FIG. 7, also by allowing all of the drive switches Sa1–Sam and the scan switches Sk1–Skn to be connected to the ground potential GND, similarly the reset state occurs.

The precharge period comes after the elapse of the reset period as shown in FIG. 8C, and performed is an operation to charge the parasitic capacitance of the EL element subjected to scanning to a voltage close to the light emission threshold voltage Vth. During this precharge period, as shown in FIG. 9, the precharge voltage Vr is applied to the data lines, and the ground potential GND is applied to a selected scan line which is subjected to scanning. A reverse bias voltage Vm is applied to non-selected scan lines.

That is, in FIG. 7, the drive switches Sa1–Sam are selected to be in the precharge voltage source VR side, for example the scan switch Sk2 corresponding to the second scan line K2 that is the scan selection line is selected to be the ground, and other scan switches Sk1, Sk3–Skn are selected to be in the reverse bias voltage source VM side. Thus, the precharge voltage Vr from the precharge voltage source VR is applied to parasitic capacitances of respective EL elements connected to the second scan line K2 that is the scan selection line, and the voltage Vr is charged in the parasitic capacitances of the EL elements connected to the second scan line K2.

Subsequently, the lighting scan period comes as shown in FIG. 8D, and during this lighting scan period current from the constant current sources I1–Im is supplied to EL elements subjected to lighting as shown in FIG. 9. For example the scan switch Sk2 corresponding to the second scan line K2 that is the scan selection line is selected to be the ground, and other scan switches Sk1, Sk3–Skn are selected to be in the reverse bias voltage VM side.

Thus, among the EL elements which are connected to the second scan line K2 that is the scan selection line and which are precharged, EL elements subjected to lighting are immediately driven to emit light, and as a result, the forward voltage Vf of the EL element is generated on this data line. At this time, the reverse bias voltage Vm is applied to the non-selected scan line, so that crosstalk light emission in respective EL elements connected to intersection points between driven data lines and scan lines which are not selected for scanning are prevented from occurring. The reset period, precharge period, and lighting scan period are sequentially repeated in synchronization with the scan synchronization signal shown in FIG. 8A.

Meanwhile, although the display panel of a passive drive type is constructed such that the reverse bias voltage Vm is applied to the non-selected scan lines to prevent crosstalk light emission as already described, the reverse bias voltage Vm has a value smaller than the forward voltage Vf of the EL element in general. Therefore, in a case where a lighting state of several or all EL elements constituting the display panel is continued over several frames or several tens of frames, the chance that a complete reverse bias voltage is applied with respect to the polarity of respective EL elements does not occur, and the effect that the light emission lifetimes of the EL elements are prolonged as described above cannot be produced.

Thus, during one frame period, during the period in which any lines are not scanned and which is designated by "none" in Table 1, the reverse bias voltage is applied to all EL elements. This period is represented as "non-lighting scan period" in FIG. 9.

During this non-lighting scan period, as shown in FIG. 9, the data lines are set at the ground GND, and performed is an operation that respective scan lines are set at the reverse bias voltage Vm. That is, the drive switches Sa1–Sam shown in FIG. 7 select the ground GND, and the scan switches Sk1–Skn select the reverse bias voltage source VM. Thus, the reverse bias voltage Vm is always applied to all of each EL element arranged on the display panel 1 at least during one frame period regardless of the lighting state of pixels.

Next, FIGS. 10(A)–(F) shows a second embodiment in which a drive control method according to the present invention is adopted, and these FIGS. 10A to 10F also successively show scan states during one frame period. In the upper half and the lower half in FIGS. 10(A)–(F), that is, in the first display area and the second display area, dual scan display is performed as already described.

Figure 10A:
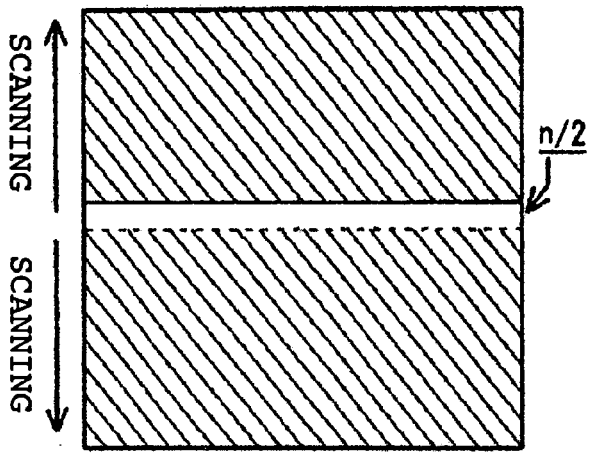
FIGS. 10A, 10B, 10C, 10D, 10F are schematic views explaining scan states in a second embodiment according to the present invention.

In the embodiment shown in this FIGS. 10(A)–(F), as shown by the arrows in FIG. 10A, adopted is a means for implementing scanning in such a way that the scan selection operation direction of the first display area and the scan selection operation direction of the second display area are different from each other. That is, adopted is a means for scanning the first through (n/2)th scan lines from the (n/2)th line to the first line sequentially (that is, from the center to the upper end of the screen) in the upper half of the panel and at the same time for scanning the (n/2+1)th through nth scan lines from the (n/2+1)th line to the nth line sequentially (that is, from the center to the lower end of the screen) in the lower half of the panel.

In the embodiment shown in FIGS. 10(A)–(F), the difference between the start time of the scan selection operation in the upper half of the panel and the start time of the scan selection operation in the lower half of the panel in each frame period is controlled to be the scanning time of one scan line. In FIGS. 10A to 10F, a line(s) on which the scan selection operation is performed, that is, a scan line(s), are shown by a white portion(s) against the black background, and the line number(s) of the scan line(s) are shown on the right side thereof.

Figure 10B:
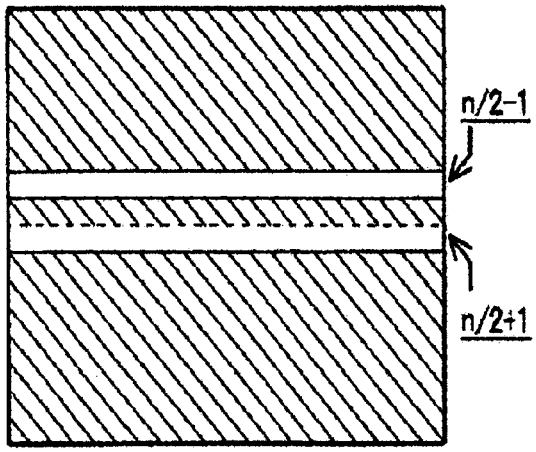

First, at the start time of one frame period, as shown in FIG. 10A, the (n/2)th line in the upper half of the panel is scanned. At this time, in the lower half of the panel, any lines are not scanned. At the next scan timing, as shown in FIG. 10B, the (n/2−1)th line in the upper half of the panel is scanned, and the (n/2+1)th line in the lower half of the panel is scanned. In this manner, the difference between the start time of the scan selection operation in the upper half of the panel and the start time of the scan selection operation in the lower half of the panel is set to the scanning time of one scan line.

Figure 10C:
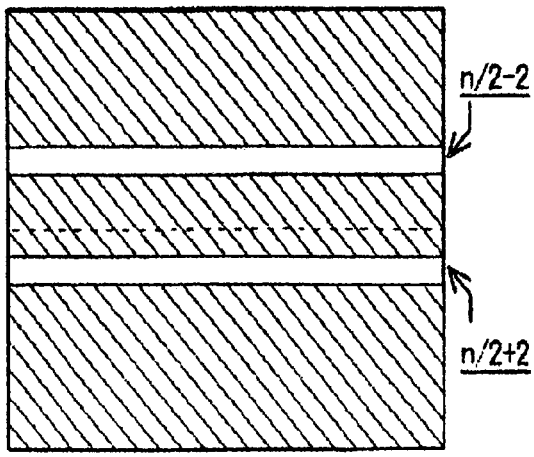

Further, at the next scan timing, as shown in FIG. 10C, the (n/2−2)th line in the upper half of the panel is scanned, and the (n/2+2)th line in the lower half of the panel is scanned. As described above, in the respective upper and lower halves of the panel, the scan selection operations are performed sequentially in synchronization with the scan timing.

Figure 10D:
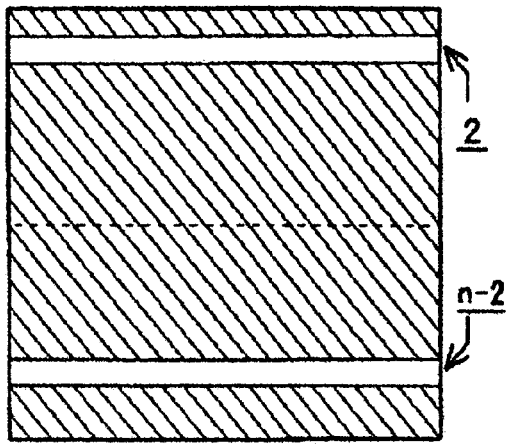
Figure 10E:
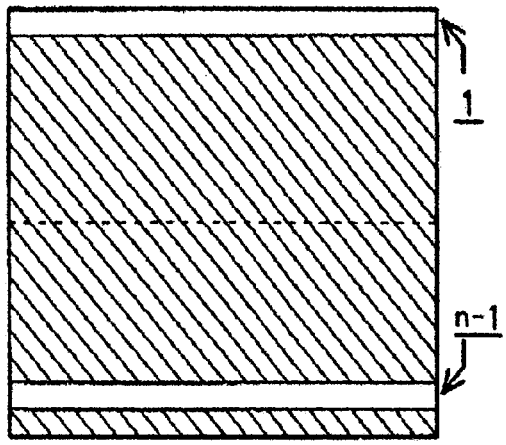

FIG. 10D and following drawings explain scan states immediately before the completion of one frame period. That is, in FIG. 10D, the second line in the upper half of the panel is scanned, and at this time the (n−2)th line is scanned in the lower half of the panel. At the next scan timing, as shown in FIG. 1E, the first line in the upper half of the panel is scanned, and at the same time the (n−1)th line in the lower half of the panel is scanned.

Figure 10F:
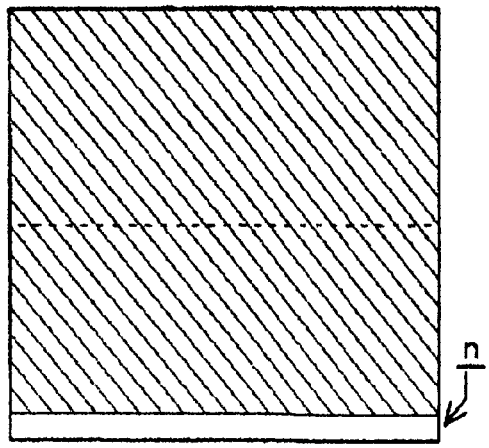

At the final scan timing of one frame period, as shown in FIG. 10F, in the upper half of the panel, the scanning operation has already been completed, and any of lines are not scanned. At this time, in the lower half of the panel, the nth final line is scanned. Summarizing, the scan states described above can be shown as the following Table 2. In Table 2, description of "none" represents a state in which any lines are not scanned in the upper half or the lower half of the panel.

TABLE 2

| | scan line | |
|---|---|---|
| scan timing | upper half | Lower half |
| a | n/2 | None |
| b | n/2 − 1 | n/2 + 1 |
| c | n/2 − 2 | n/2 + 2 |
| . . . | . . . | . . . |
| d | 2 | n − 2 |
| e | 1 | n − 1 |
| f | none | N |

In the case where the scan method shown in FIG. 10 is adopted also, adjacent scan lines are not simultaneously brought to the scan selection state, and thus the problem that a bright line is generated momentarily on the boundary line of the upper half and the lower half of the panel can be avoided. Since the direction of the scan selection operation of the upper half of the panel and the direction of the scan selection operation of the lower half of the panel are different from each other, the time gap of scan timings close to the boundary line of the upper half and the lower half of the panel can be decreased, and the occurrence of sense of incompatibility recognized by an afterimage of human vision as already described can be resolved effectively.

By employing the structure of the display panel 1A and the drive circuit therefor (the data driver 2 and the scan driver 3) shown in FIG. 7 as already described even in the upper half of the panel and the lower half of the panel shown in FIG. 10, the reset operation and the precharge operation as shown in FIGS. 8 and 9 can be performed. Further, during the period shown as "none" in Table 2, the reverse bias voltage Vm can be applied to the respective EL elements arranged on the display panel 1A as described above, and thus the light emission lifetimes of the EL elements can be prolonged.

FIGS. 11(A)–(F) shows a third embodiment in which a drive control method according to the present invention is adopted, and these FIGS. 11A to 11F also successively show scan states during one frame period. In the upper half and the lower half in FIGS. 11(A)–(F), that is, in the first display area and the second display area also, dual scan display is performed as already described.

Figure 11A:
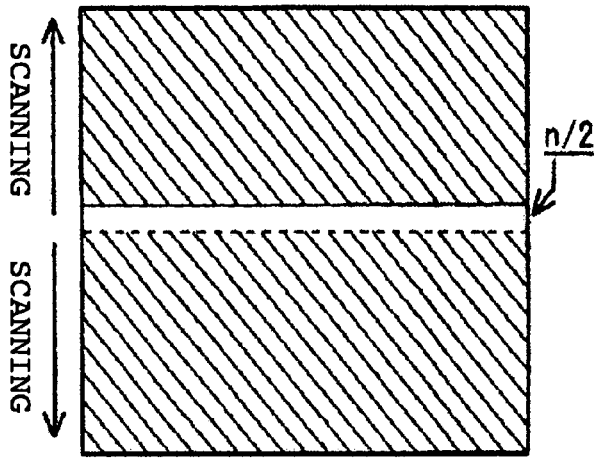
FIGS. 11A, 11B, 11C, 11D, 11F are schematic views explaining scan states in a third embodiment similarly.

In the embodiment shown in this FIGS. 11(A)–(F) also, as shown by the arrows in FIG. 11A, adopted is a means for implementing scanning in such a way that the scan selection operation direction of the first display area and the scan selection operation direction of the second display area are different from each other. That is, adopted is a means for scanning the first through (n/2)th scan lines from the (n/2)th line to the first line sequentially (that is, from the center to the upper end of the screen) in the upper half of the panel and for scanning the (n/2+1)th through nth scan lines from the (n/2+1)th line to the nth line sequentially (that is, from the center to the lower end of the screen) in the lower half of the panel.

In the embodiment shown in FIGS. 11(A)–(F), the difference between the start time of the scan selection operation in the upper half of the panel and the start time of the scan selection operation in the lower half of the panel in each frame period is controlled to be the scan time of two scan lines. In FIGS. 11A to 11F, a line(s) on which the scan selection operation is performed, that is, a scan line(s), are shown by a white portion(s) against the black background, and the line number(s) of the scan line(s) are shown on the right side thereof.

Figure 11B:
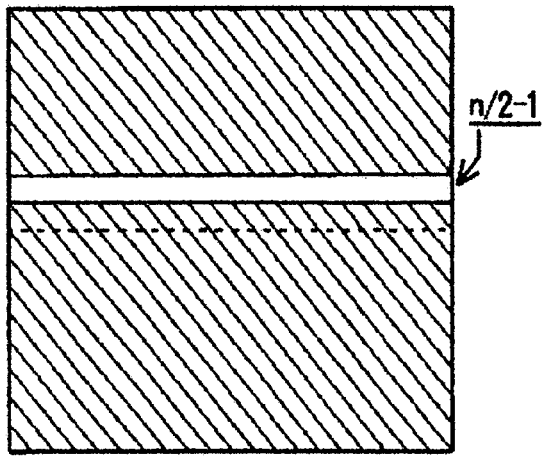

First, at the start time of one frame period, as shown in FIG. 11A, the (n/2)th line in the upper half of the panel is scanned. At this time, in the lower half of the panel, any lines are not scanned. At the next scan timing, as shown in FIG. 11B, the (n/2−1)th line in the upper half of the panel is scanned, and even at this time in the lower half of the panel any lines are not scanned.

Figure 11C:
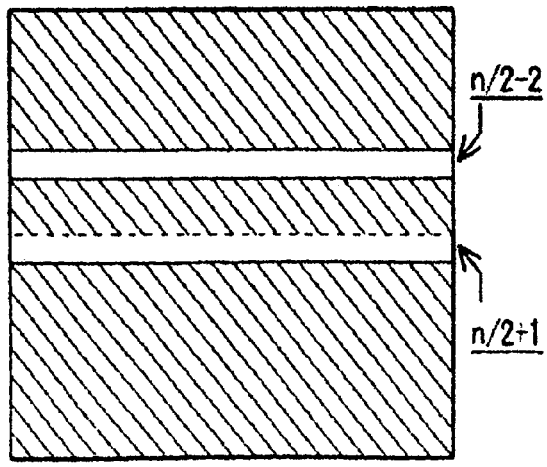

Further, at the next scan timing, as shown in FIG. 11C, the (n/2−2)th line in the upper half of the panel is scanned, and at the same time the (n/2+1)th line in the lower half of the panel is scanned. In this manner, the difference between the start time of the scan selection operation in the upper half of the panel and the start time of the scan selection operation in the lower half of the panel is set to the scanning time of two scan lines. As described above, in the respective upper and lower halves of the panel, the scan selection operations are performed sequentially in synchronization with the scan timing.

Figure 11D:
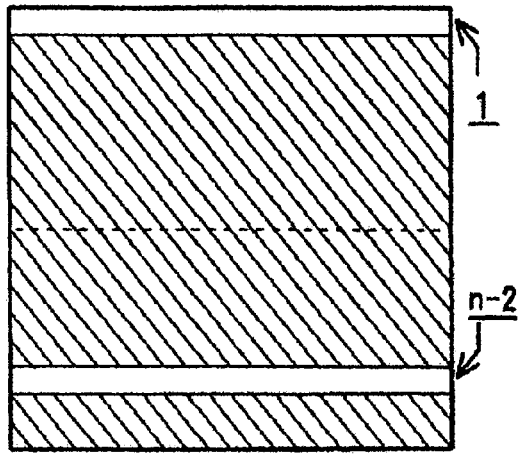
Figure 11E:
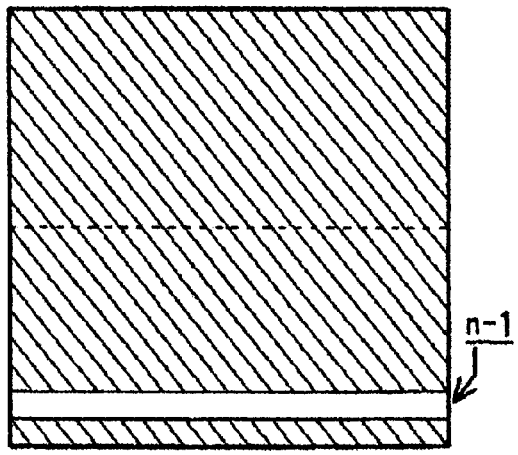

FIG. 11D and following drawings explain scan states immediately before the completion of one frame period. That is, in FIG. 11D, the first line in the upper half of the panel is scanned, and at this time the (n−2)th line is scanned in the lower half of the panel. At the next scan timing, as shown in FIG. 11E, in the upper half of the panel, the scanning operation has already been completed, and any lines are not scanned. At this time in the lower half of the panel, the (n−1)th line is scanned.

Figure 11F:
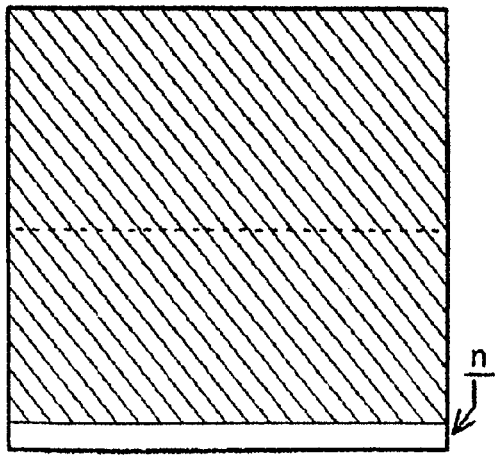

At the final scan timing of one frame period, as shown in FIG. 11F, in the upper half of the panel, the scanning operation has been completed similarly, and any of lines are not scanned. At this time, in the lower half of the panel, the nth final line is scanned. Summarizing, the scan states described above can be shown as the following Table 3. In Table 3, description of "none" represents a state in which any lines are not scanned in the upper half or the lower half of the panel.

TABLE 3

| | scan line | |
|---|---|---|
| Scan timing | upper half | Lower half |
| a | n/2 | None |
| b | n/2 − 1 | None |
| c | n/2 − 2 | n/2 + 1 |
| . . . | . . . | . . . |
| d | 1 | n − 2 |
| e | none | n − 1 |
| f | none | N |

In the case where the scan method shown in FIG. 11 is adopted also, adjacent scan lines are not simultaneously brought to the scan selection state, and thus the problem that a bright line is generated momentarily on the boundary line of the upper half and the lower half of the panel can be avoided. Since the direction of the scan selection operation of the upper half of the panel and the direction of the scan selection operation of the lower half of the panel are different from each other, the time gap of scan timings close to the boundary line of the upper half and the lower half of the panel can be decreased, and the occurrence of sense of incompatibility recognized by an afterimage of human vision as already described can be resolved effectively.

By employing the structure of the display panel 1A and the drive circuit therefor (the data driver 2 and the scan driver 3) shown in FIG. 7 as already described even in the upper half of the panel and the lower half of the panel shown in FIG. 11, the reset operation and the precharge operation as shown in FIGS. 8 and 9 can be performed. Further, during the period shown as "none" in Table 3, the reverse bias voltage Vm can be applied to the respective EL elements arranged on the display panel 1A as described above, and thus the light emission lifetimes of the EL elements can be prolonged.

In the embodiments according to the present invention described above, although described are the examples in which organic EL elements are employed as self light emitting elements arranged on the display panel, other elements having a diode characteristic can also be employed as the self light emitting elements.

What is claimed is:

1. A passive matrix type self light emitting display panel which has a first display area and a second display area to perform dual scan display and which is constructed to allow a data driver to give display data to self light emitting elements arranged in the respective display areas and to allow scan selection operations of the first and second display areas to be sequentially performed in synchronization with each other by a scan driver, further comprising:

a scanning means for controlling a start time of the scan selection operation of the first display area and a start time of the scan selection operation of the second display area in each frame period, wherein a difference between the start time of the scan selection operation of the first display area and the start time of the scan selection operation of the second display area is scanning time of at least one or more scan lines, and wherein a period with no scan selection being performed occurs in either one of said first display area and said second display area for said each frame period.

2. The self light emitting display panel according to claim 1, comprising numbers of scan lines in the first display area and the second display area, wherein the number of scan lines in the first display area and the second display area are equal to each other.

3. The self light emitting display panel according to claim 1, constructed in such a way that the scanning means can implement scanning, wherein a direction of the scan selection operation in the first display area and a direction of the scan selection operation in the second display area are different from each other.

4. The self light emitting display panel according to claim 3, comprising numbers of scan lines in the first display area and the second display area, wherein the numbers of scan lines in the first display area and the second display area are equal to each other.

5. The self light emitting display panel according to any one of claims 1 to 4, constructed in such a way that a reverse bias voltage is applied to the self light emitting elements by the scan driver and the data driver during part of a period in which scan selection is not implemented.

6. The self light emitting display panel according to claim 5, wherein each of the self light emitting elements is an organic EL element which has at least one organic light emission functional layer between electrodes.

7. The self light emitting display panel according to claim 6, wherein said period with no scan selection being performed including either one of the first scan timing and the final scan timing.

8. The self light emitting display panel according to claim 5, wherein said period with no scan selection being performed including either one of the first scan timing and the final scan timing.

9. The self light emitting display panel according to any one of claims 1 to 4, wherein each of the self light emitting elements is an organic EL element which has at least one organic light emission functional layer between electrodes.

10. The self light emitting display panel according to claim 9, wherein said period with no scan selection being performed including either one of the first scan timing and the final scan timing.

11. The self light emitting display panel according to any one of claims 1 through 4, wherein said period with no scan selection being performed including either one of the first scan timing and the final scan timing.

12. A drive control method for a passive matrix type self light emitting display panel which has a first display area and a second display area to perform dual scan display and which is constructed to allow a data drive to give display data to self light emitting elements arranged in the respective display areas and to allow scan selection operation of the first and second display areas to be sequentially performed in synchronization with each other by a scan driver, comprising:

controlling a start time of the scan selection operation of the first display area and a start time of the scan selection operation of the second display area in each time frame period, such that a difference between the start time of the scan selection operation of the first display area and the start time of the scan selection operation of the second display area is the scanning time of at least one or more scan lines, and wherein a period with no scan selection being performed occurs in either one of said first display area and said second display area for said each frame period.

13. The drive control method of the self light emitting display panel according to claim 12, further comprising applying a reverse, bias voltage to the self light emitting elements by the scan driver and the data driver during part of a period in which scan selection is not implemented.

14. The drive control method of the self light emitting display according to claim 12 or 13, wherein said period with no scan selection being performed including either one of the first scan timing and the final scan timing.

* * * * *